United States Patent [19]

Lehr

[11] Patent Number: 4,843,519

[45] Date of Patent: Jun. 27, 1989

[54] SWITCHING PANEL WITH DESK-LIKE CASING

[75] Inventor: Lothar Lehr, Burbach-Oberdresselndorf, Fed. Rep. of Germany

[73] Assignee: Rittal-Werk Rudolf Loh GmbH & Co. KG, Stutzelberg, Fed. Rep. of Germany

[21] Appl. No.: 164,528

[22] Filed: Mar. 7, 1988

[30] Foreign Application Priority Data

Mar. 7, 1987 [DE] Fed. Rep. of Germany ..... 3707390

[51] Int. Cl.[4] ..... H02B 1/08

[52] U.S. Cl. ..... 361/356; 16/124; 312/327; 361/390

[58] Field of Search ..... 16/124; 174/50, 66, 174/67; 312/327-328; 361/346, 356-359, 340, 390, 364; D8/353; D13/30, 31, 35, 40

[56] References Cited

U.S. PATENT DOCUMENTS

| | | | |
|---|---|---|---|
| 2,695,690 | 11/1954 | Rees et al. | 16/124 |
| 2,941,235 | 6/1960 | S hwartz et al. | 16/124 |
| 3,098,686 | 7/1963 | Benoit | 16/124 |
| 3,107,389 | 10/1963 | Engelbrecht | 16/124 |
| 3,294,463 | 12/1966 | Kafferlin et al. | 16/124 |

FOREIGN PATENT DOCUMENTS

| | | |
|---|---|---|
| 0263474 | 10/1963 | Fed. Rep. of Germany . |
| 0274606 | 4/1951 | Switzerland . |

OTHER PUBLICATIONS

German Catalog, "Das Grosse Schaltschrank-Sofortprogramm 82", Firma Rittal-Werk in Herborn, 1982, pp. 63 and 71.

*Primary Examiner*—A. D. Pellinen
*Assistant Examiner*—Gregory D. Thompson
*Attorney, Agent, or Firm*—Thomas W. Speckman; Douglas H. Pauley

[57] ABSTRACT

This invention relates to a switching panel with a desk-like casing part, the open upper side of which is provided with a peripheral sealing flange and which is inclined downwardly to its forward wall. The casing opening can be closed by a lid, which is supported in a hinged manner in the area of the upper, horizontal side of the casing opening. The lid has a peripheral rounded edge which in the closed position of the lid encloses the sealing flange and extends with the forward and edge sections of the lid over a portion of the forward wall of the casing part. The free end of the forward edge section is bent toward forward wall of the casing part. To avoid injury when closing the lid, the free end of the forward edge section is first bent inwardly at an acute angle forming a first handle section. The free end extends approximately to the free edges of the laterally adjacent edge sections. Through the formation of a handle opening which has an approximately inverted V-shaped cross section, the free end of the forward edge section further extends over a second handle section. The free end of the forward section is externally bent somewhat snugly with the free edges of the laterally adjacent edge sections.

8 Claims, 2 Drawing Sheets

SWITCHING PANEL WITH DESK-LIKE CASING

BACKGROUND OF THE INVENTION

1. Field of the Invention

This invention relates to a switching panel with a desk-like casing part, the open upper side of which has a peripheral sealing flange which is inclined downwardly toward its forward wall. The casing opening can be closed with a lid which is supported and hinged in an upper area of the horizontal side of the casing opening. The casing opening has a peripheral rounded edge which, in the open position of the lid, encloses the sealing flange and extends with the forward and edge sections connected laterally to the same over a portion of the forward wall of the casing part. The free end of the forward edge section is bent toward the forward wall of the casing part.

2. Description of the Prior Art

The lid is gripped at the forward edge part to open and shut the lid. Thus when opening the lid, the rounded end of the forward edge section is generally enclosed and injury may occur, particularly in the case of large and heavy metal lids, since only a very small distance exists between the forward edge section of the lid and the forward wall of the casing part. Also, the sealing flange on the forward side of the casing opening protrudes in the form of a sharp edge. If the lid is enclosed on the angled end of the forward edge section, then fingers can be clamped and injured as they pass through the sealing edge between the sealing flange and the forward edge part of the lid.

SUMMARY OF THE INVENTION

It is an object of this invention to provide a lid for a switching panel such that the forward edge section can easily be grasped and handled without injury to fingers.

In accordance with one embodiment of this invention, a free end of the forward edge section is first bent inwardly at an acute angle over the first handle section and extends roughly to the free edges of the laterally adjoining edge sections. The free end of the forward section of a handle roughly having a V-shaped cross section, is again bent externally in a somewhat snugly sealing manner with the free edges of the laterally adjacent border sections.

The bending of the free end of the forward edge section of the lid forms a handle. Thus the lid can be grasped without the fingers projecting into the space between the forward wall of the casing part and the forward edge section. Thus, particularly when closing the lid, fingers do not touch the sealing flange of the forward side of the casing opening. Thus injury is no longer a concern when handling the lid.

The aesthetics of the lid can be essentially retained since the laterally adjacent edge sections extend over the handle with cover sections that laterally seal off the handle. This extension has significance because the forward wall of the casing part makes a transition into the base of the casing part by way of an inclined wall section. In the closed position of the lid, the forward edge section of the lid with the laterally adjacent edge sections extends as far as the inclined wall section of the casing part. The lines of covering sections of the laterally adjacent edge sections roughly extend to the inclined wall section of the casing part. Thus the side views of the switching panel of this invention remain unchanged relative to the known switching panels.

So that the lid, can clear the forward wall of the casing part when closing the sealing flange, the edge sections which are laterally adjacent to the forward edge section of the lid, in the closed position of the lid, have free edges at a distance parallel to the forward wall of the casing part. This distance is based on the degree of overlap between the forward edge section of the lid and the forward wall of the casing part.

The handle on the angled end of the forward edge section of the lid is preferably constructed so that the first handle section of the handle is at an angle of approximately 45 degrees to the forward edge section of the lid. Both of the handle sections of the handle are at an angle of approximately 45 degrees to one another. The bends from the forward edge section to the first handle section and from the first handle section to the section handle section are rounded off.

BRIEF DESCRIPTION OF THE DRAWINGS

This invention is illustrated in greater detail by means of one embodiment shown in the drawings, wherein.

DESCRIPTION OF THE PREFERRED EMBODIMENTS

Figure 1:
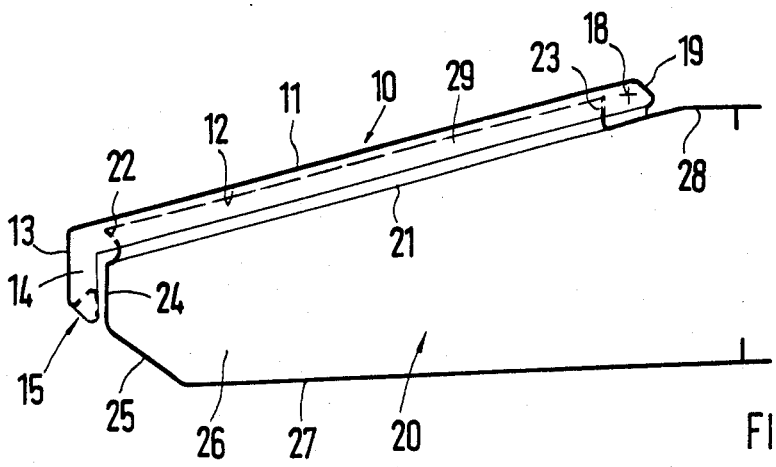
FIG. 1 shows a partial side view of a desk-like casing, which projects on a switching panel, with the lid closed.
Figure 2:
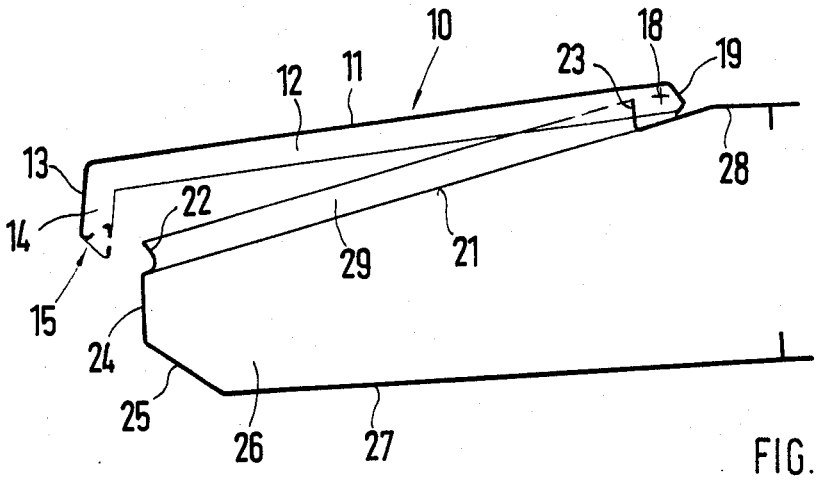
FIG. 2 shows the casing part in accordance with FIG. 1, whereby the lid is positioned in a closed position.
Figure 3:
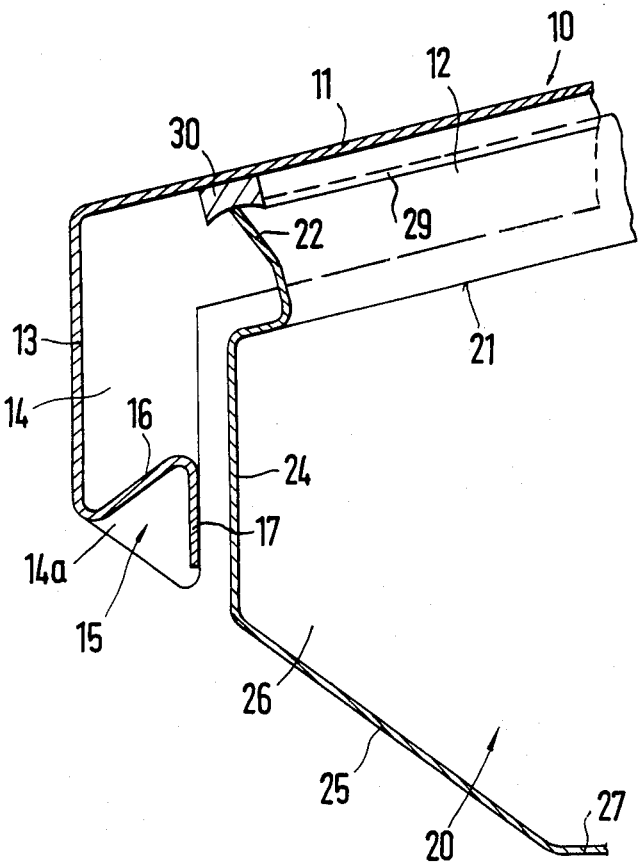
FIG. 3 shows an enlarged partial section through the forward part of the casing part with the lid closed.

In the embodiment in accordance with FIGS. 1 to 3, the projecting desk-like casing part (20) of the switching panel is shown, which has a casing opening (21) on an upper, open side. This upper side has a peripheral sealing flange which comprises bent or rounded sections (22, 23 and 29) of the forward wall (24), the covering wall (28) and the lateral walls (26), respectively, of the casing part. The forward wall (24) of the casing part (20) goes downward into the inclined wall section (25) and into the base (27) of the casing part (20). The open rear side of the casing part (20) forms the transition to a space of the switching panel, as FIGS. 1 and 2 indicate in the right-hand part.

The casing opening (21) is inclined downward toward the forward wall (24), and is closed by the lid (10) has a top (11). The lid (10) is constructed in a plate-like manner and peripherally reinforced by the rounded edge, as the edge sections (12, 13, 14 and 19) show. The lid (10) in the closed position encloses, with its edge, the casing opening (21). In this manner, the lid (10) is positioned with a sealing element (30) on the free edge of the sealing flange, as FIG. 3 clearly shows. The sealing element (30) is attached on the inner side of the lid (10) and follows the contour of the peripheral sealing flange. As the pivot axis (18) shows, the lid (10) is supported and hinged on the casing part (20) outside the bend or rounded section (23) of the sealing flange.

The forward edge section (13) of the lid (10) is so extended with the laterally adjacent edge section (14) that, in the closed position, the forward wall (24) of the casing part (20) is covered. In such closed position, the free edges of the laterally adjacent edge sections are parallel and at a predetermined distance from the forward wall (24) of the casing part (20). This arrangement allows the forward edge section (13) of the lid (10), when the lid (10) is closed, to safely clear the forward bent or rounded section (22) of the peripheral sealing flange.

FIG. 3 shows the free end of the forward edge section (13) first bent inwardly at an angle approximately 45° as a first handle section (16). This first handle section (16) extends approximately to the free edges of the laterally adjacent edge section (14). The free end of the forward edge section (13) continues as a second handle section (17) which is bent outwardly by approximately 45° with respect to the first handle section (16). The second handle section (17) thereby closes somewhat snugly with the free edges of the laterally adjacent edge sections (14). Both the handle sections (16 and 17) form a handle opening (15) with an approximately V-shaped cross section. The laterally adjacent edge sections (14) are laterally extended over the handle opening (15) and laterally close the handle opening with the cover sections (14*a*). In the closed position of the lid (10), the free edges of the cover sections (14*a*) are aligned with and appear to form an extension to the inclined wall section (25).

As shown in FIG. 3, the lid (10) can easily be grasped with fingertips by using the handle opening (15). Thus the lid (10) can be grasped and held without fingers coming into injurious contact when the lid (10) passes the forward section (22) of the sealing flange. This is particularly important when closing the lid (10), so that finger injuries are avoided. In switching panels, the lid (10) may be metal and is, in large casing parts (20), very heavy which makes it more important to avoid clamping of fingers. By means of the handle opening which is simply produced, a definite grasping and holding of the lid (10) during the opening and closing of the lid (10) is ensured, and the danger of injury is eliminated.

I claim:

1. In a switching panel having a desk-like casing part with a casing opening, an open upper side with a peripheral sealing flange, said upper side inclined downwardly toward a forward wall, a lid closing said casing opening, said lip supported and hinged in an upper area of a horizontal side of said casing opening, said lid having peripheral rounded edge sections, in a closed position of said lid, said peripheral rounded edge sections enclosing said peripheral sealing flange, a forward edge section of said lid extending over said peripheral rounded edge sections and a portion of said forward wall of said casing part, the improvement comprising: a forward edge section (13) of said peripheral rounded edge sections having a lower free end bent inwardly at an acute angle forming an inclined first handle section (16) extending between free edges of each of two laterally adjacent edge sections (14) of said lid (10), said free end further bent downwardly at an acute angle with respect to said first handle section (16) forming a second handle section (17) which follows a vertical free edge, of each said laterally adjacent edge sections (14) forming a handle opening (15); said forward edge section (13), said first handle section (16) and said second handle section (17) forming a one-piece handle with said lid, said handle opening (15) having a generally inverted V-shaped cross section.

2. In a switching panel in accordance with claim 1, wherein said laterally adjacent edge sections (14) extend over said handle opening (15) with cover sections (14*a*) and said cover sections (14*a*) laterally enclose said handle opening (15).

3. In a switching panel in accordance with claim 2, wherein said forward wall (24) of said casing part (20) connects into a base (27) of said casing part (20) by way of an inclined wall section (25) and in said closed position of said lid (10), said cover sections (14*a*) each having a cover free edge aligned with said inclined wall section (25) of said casing part (20).

4. In a switching panel in accordance with claim 3, wherein each said laterally adjacent edge section (14) is laterally adjacent to said forward edge section (13) of said lid (10), in said closed position of said lid (10), said vertical free edge of each said laterally adjacent edge section (14) runs at a distance parallel to said forward wall (24) of said casing part (20).

5. In a switching panel in accordance with claim 4, wherein said first handle section (16) is at an acute angle of approximately 45° to said forward edge section (13) of said lid (10), said first handle section (16) is at an acute angle of approximately 45° to said second handle section (17), and said free end has a first rounded edge on a first bend between said forward edge section (13) and said first handle section (16) and a second rounded edge on a second bend between said first handle section (16) and said second handle section (17).

6. In a switching panel in accordance with claim 1, wherein said forward wall (24) of said casing part (20) connects into a base (27) of said casing part (20) by way of an inclined wall section (25) and in said closed position of said lid (10), cover sections (14*a*) each having a cover free edge aligned with said inclined wall section (25) of said casing part (20).

7. In a switching panel in accordance with claim 1, wherein each said laterally adjacent edge section (14) is laterally adjacent to said forward edge section (13) of said lid (10), in said closed position of said lid (10), said vertical free edge of each said laterally adjacent edge section (14) runs at a distance parallel to said forward wall (24) of said casing part (20).

8. In a switching panel in accordance with claim 1, wherein said first handle section (16) is at an acute angle of approximately 45° to said forward edge section (13) of said lid (10), said first handle section (16) is at an acute angle of approximately 45° to said second handle section (17), and said free end has a first rounded edge on a first bend between said forward edge section (13) and said first handle section (16) and a second rounded edge on a second bend between said first handle section (16) and said second handle section (17).

* * * * *